United States Patent [19]

Nordlof

[11] Patent Number: 4,594,872

[45] Date of Patent: Jun. 17, 1986

[54] APPARATUS FOR STRAIGHTENING STRIP MATERIAL

[76] Inventor: Richard D. Nordlof, 3312 Crest Rd., Rockford, Ill. 61107

[21] Appl. No.: 666,494

[22] Filed: Oct. 30, 1984

[51] Int. Cl.[4] ..... B21D 1/02

[52] U.S. Cl. ..... 72/164

[58] Field of Search ..... 72/164, 165, 162, 160

[56] References Cited

U.S. PATENT DOCUMENTS

| | | | |
|---|---|---|---|
| 1,003,575 | 9/1911 | Abramsen . | |
| 1,867,343 | 7/1932 | Witter | 72/164 |
| 1,923,738 | 8/1933 | McBain . | |
| 1,959,492 | 5/1934 | Moses | 72/165 |
| 2,318,160 | 5/1943 | Johnson | 72/165 |
| 2,852,065 | 9/1958 | Peterson | 72/164 |
| 2,870,818 | 1/1959 | Herr | 72/164 |
| 2,949,147 | 8/1960 | Maust | 72/164 |
| 3,301,031 | 1/1967 | Bearer | 72/164 |
| 3,605,471 | 9/1971 | Bodtke . | |
| 3,621,693 | 11/1971 | Adams | 72/164 |
| 3,765,210 | 10/1973 | Lemper . | |
| 3,834,202 | 9/1974 | Kawaguchi et al. | 72/165 |

FOREIGN PATENT DOCUMENTS

| | | | |
|---|---|---|---|
| 746765 | 3/1956 | United Kingdom | 72/164 |
| 929345 | 6/1963 | United Kingdom | 72/165 |

*Primary Examiner*—Daniel C. Crane

*Attorney, Agent, or Firm*—Vernon J. Pillote

[57] ABSTRACT

An apparatus for straightening strip stock in which a series of lower leveler rollers are mounted in uniform fixed parallel relation on a lower rigid roller support and a series of upper leveler rollers are mounted in uniform fixed parallel relation on an upper rigid roller support. The roller supports are adjustable relative to each other in a direction parallel to the stock pass line and the roller supports are also adjustable relative to each other in a direction transverse to the stock pass line.

23 Claims, 13 Drawing Figures

204
203
12
210
211
212
121b
122
188
195
141
142
166
148
133
9
121a
9
177
178

10
11
133
132
195
141
138
122
142
151
150
188
156
155
149
150a
148
189
191a
156a
139
135
152
131
135b
135a
216
178
128
180
175a
175b
175c
175d
175e
179
181
176a
176b
176c
176d
177
10
11
121

APPARATUS FOR STRAIGHTENING STRIP MATERIAL

BACKGROUND OF THE INVENTION

The present invention relates to an apparatus for straightening strip material as it is fed from a supply coil to a punch press. The coiled strip material usually has a coil set or curvature caused by coiling the material and which varies with the size of the coil, and thickness and type of material, and the strip material also sometimes has edge damage that occurs during handling of the coil. The direction of coil set or curvature of the strip material as it is unwound from the coil can be either up curvature if the strip is unwound from the underside of the coil or down curvature if the strip is unwound from the top of the coil. It is common practice to pass the strip material from the supply coil through a roller leveler or straightener to flatten the strip before passing it to a punch press, to minimize damage to the dies and improve the quality of parts produced in the punch press. Such roller levelers usually use a number of upper and lower rollers which are staggered with relation to each other so that the stock is first bent in one direction and then in the other as it passes through the roller leveler. Some roller levelers mount the rollers of one set such as the set of upper rollers for individual adjustment in a direction transverse to the pass line of the strip material to accommodate material of different thickness and type and to control the amount and direction of bending of the material at successive locations along the leveler. Such levelers require substantial skill and time to properly adjust the same in accordance with the thickness, type and coil set in the material being supplied to the straightener. Some other roller levelers such as shown in U.S. Pat. Nos. 1,923,738 and U.S. Pat. No. 3,605,471, mount the upper rollers in a frame that is adjustable toward and away from the lower rollers, to accommodate material of different thickness. Still other levelers for heavy rails, beams, plates and the like such as disclosed in U.S. Pat. Nos. 1,003,575; 1,959,492; 3,621,693 and 3,765,210 mount the rollers of the upper and lower sets so that the spacing between adjacent rollers of the upper set and the spacing between adjacent rollers of the lower set can be individually adjusted in a direction lengthwise of the stock pass line to change the effective length of the leveler assembly.

SUMMARY OF THE INVENTION

It is an object of the present invention to provide an apparatus for straightening strip material which is easily adjustable to straighten strip material having either coil set up or coil set down as it enters the straightner.

Accordingly, the present invention provides an apparatus for straightening strip material in which a first series of leveler rollers are rotatably mounted in fixed uniform parallel relation on a first roller support and a second series of leveler rollers are rotatably mounted in fixed parallel relation on a second roller support with the spacing of the second series of rollers being the same as the spacing of the first series of rollers. The first and second roller supports are mounted at relatively opposite sides of the stock pass line for relative adjustment along a first path lengthwise of the stock pass line and also for relative adjustment along a second pass transverse stock pass line, and a selectively operable longitudinal adjusting means is provided to relatively adjust the first and second roller supports along the first path and a selectively operable transverse adjusting means is provided for relatively adjusting the roller supports along the second path. With this arrangement, the leveler rollers of one series can be moved from a position in which they are each disposed between and equi-distant from two adjacent leveler rollers of the other series, into positions in which the leveler rollers of the one series are disposed between and relatively closer to either the upstream one or the downstream one of the two adjacent leveler rollers of the other series. Movement of the rollers of one series so that they are relatively closer to the upstream one of two adjacent rollers of the other series changes the direction and amount of bend imparted to the strip material, from that which occurs when the rollers of one series are moved relatively closer to the downstream one of the two adjacent leveler rollers.

The transverse adjusting means preferably includes a first means for adjusting the position of one roller support in a direction transverse to the pass line adjacent the entrance end and a second means for adjusting the position of the roller support in a direction transverse the pass line adjacent the exit end to enable the amount of bending imparted to the strip material by the rollers to be varied as it passes along the leveler. One roller support and the series of rollers mounted thereon are preferably mounted on a cover that can be moved between an open and closed position to facilitate threading the strip material through the straightener.

In one embodiment, the straightener is of the non-powered type and has a pair of pinch rollers at the inlet end of the straightener with a brake means for retarding rotation of one of the pinch rollers, to thereby tension the strip material as it is drawn through the leveler rollers. In another embodiment, the leveler rollers are powered and the straightening apparatus has pinch rollers that are driven to feed material through the straightening apparatus.

Figure 1:
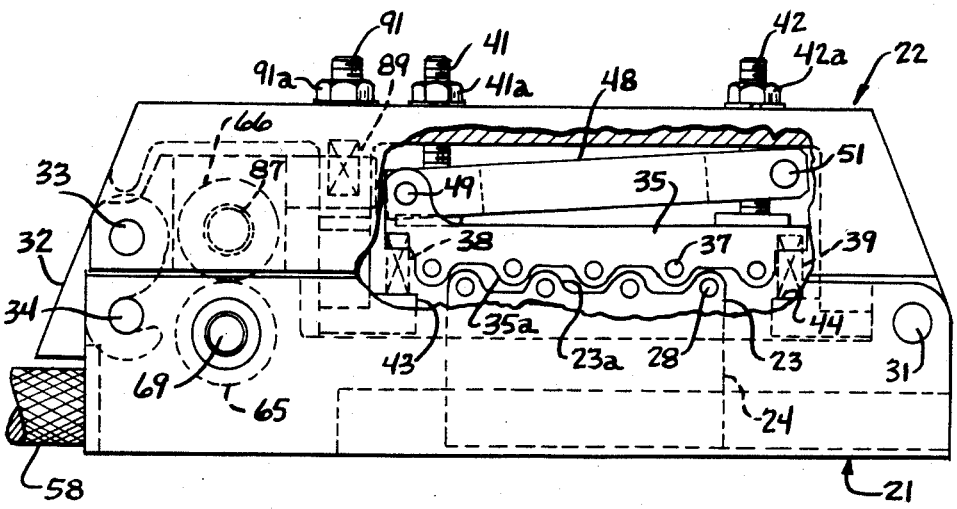
FIG. 1 is a side elevational view of an apparatus for straightening strip material embodying the present invention.
Figure 2:
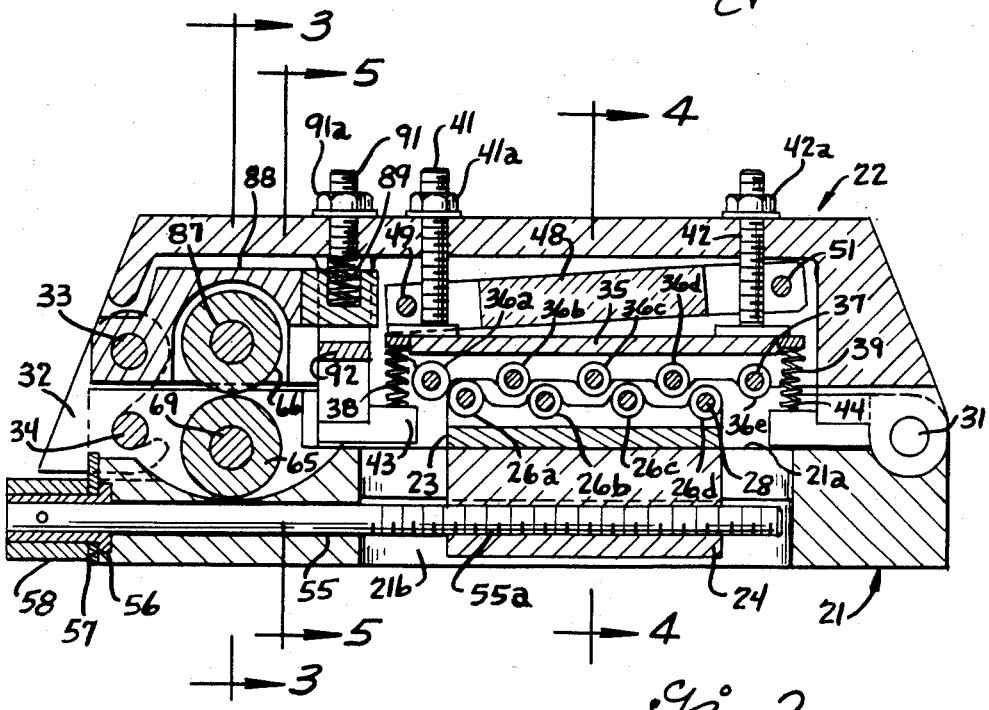
FIG. 2 is a longitudinal sectional view through the straightening apparatus, taken on the plane 2—2 of FIG. 3.
Figure 3:
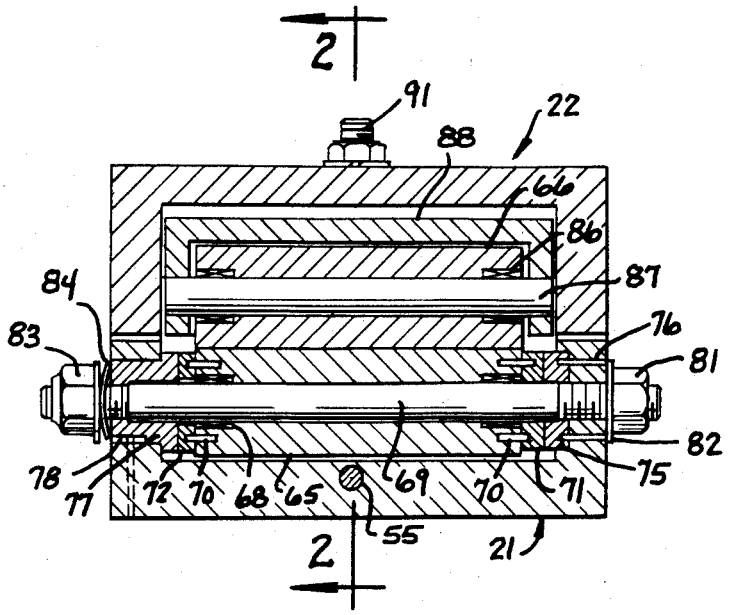
FIG. 3 is a transverse sectional view taken on the plane 3—3 of FIG. 2.
Figure 4:
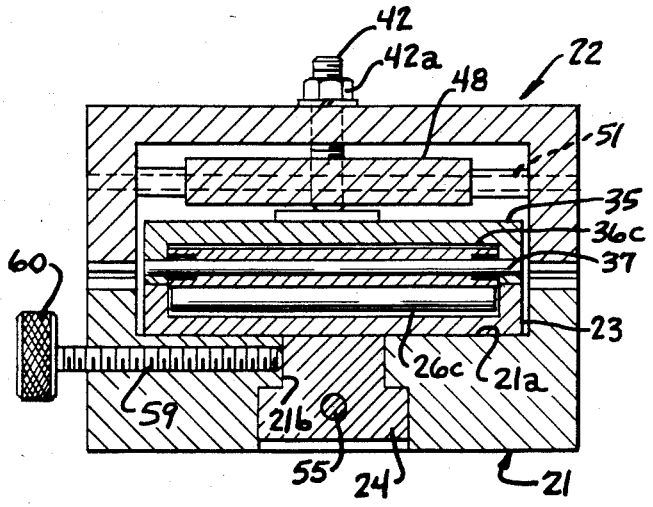
FIG. 4 is a transverse sectional view taken on the plane 4—4 of FIG. 2.
Figure 5:
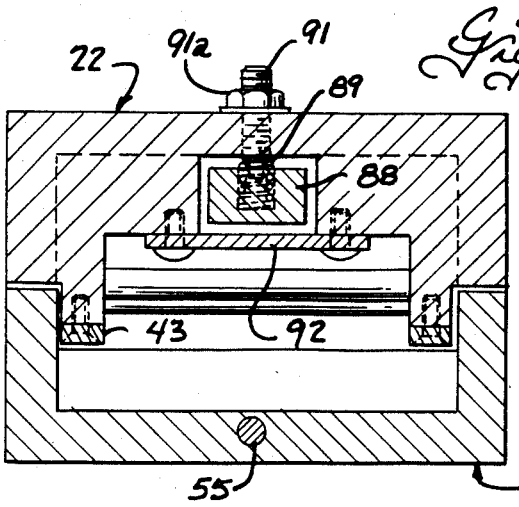
FIG. 5 is a transverse sectional view taken on the plane 5—5 of FIG. 2.

The apparatus for straightening strip material shown in FIGS. 1–7 of the non-powered type and includes a base 21 and a cover 22. A rigid lower roller support 23 is mounted on the base for adjustment therealong in a direction lengthwise of the pass line of the strip material as it passes through the straightener and, as best shown in FIGS. 2 and 4, the roller support 23 is slidably supported on an upper face 21*a* on the base, and a guide block 24 is secured to the underside of the lower roller support and is guidably received in a slot 21*b* in the base. A series of lower leveler rollers, herein shown four in number and designated 26*a*–26*d*, are rotatably mounted on the lower roller support with their axes uniformly spaced apart a fixed distance. The lower rollers are preferably of like diameter and have their upper peripheries disposed tangent to a lower roller plane. The lower rollers have bearings (not shown) adjacent opposite ends that rotatably support the same on axes 28 that extend through ears 23*a* on the lower roller support.

The cover 22 is pivotally mounted by a pin 31 on the base adjacent the outlet end of the straightening apparatus for swinging movement between a closed or operating position shown in the drawings, and a raised position to facilitate threading of the strip material through the straightening apparatus. The cover is releasably held in its closed position by a pair of latches 32 that are pivotally mounted on a cross shaft 33 on the cover adjacent its inlet end, and which latches have hook portions arranged to engage keeper pins 34 on the base. As will be understood, the latches 32 are spaced apart a distance greater than the width of the strip material to be straightened so as to not interfere with the passage of the strip material through the straightener.

A rigid upper roller support 35 is mounted on the cover and a series of upper rollers, herein shown five in number and designated 36*a*–36*e*, are rotatably mounted on the upper roller support with their axes uniformly spaced apart a fixed distance and with their underside disposed tangent to an upper roller plane. The upper leveler rollers are preferably of like outer diameter the same as the lower leveler rollers and are rotatably supported by bearings on axles 37 that extend through ears 35*a* on the upper roller support. The spacing between the axes of the upper rollers is substantially greater than the diameter of the upper rollers and preferably about two times the roller diameter. The upper roller support is mounted for adjustment along a second path transverse to the pass line of the strip material, toward and away from the lower roller support. A first means including a pair of springs 38 and adjusting screw 41 is provided for adjusting the vertical position of the upper roller support adjacent its entrance end and a second means including a pair of springs 39 and an adjusting screw 42 is provided for adjusting the position of the upper roller support along the second path adjacent its exit end. The pair of springs 38 are spaced apart a distance greater than the width of the strip material and are interposed between bosses 42 on the cover and the underside of the upper roller support to yieldably bias the same upwardly, and screw 41 is threaded in the cover and engages a thrust pad on the upper side of the upper roller support to provide a vertically adjustable upper stop for the entrance end of the upper roller support. Similarly, the pair of springs 39 are laterally spaced apart a distance greater than the width of the strip material and are interposed between the bosses 44 on the cover and the underside of the upper roller support adjacent its outlet end to yieldably bias the same upwardly. Screws 42 are threaded in the cover and engage thrust plates at the upper side of the roller support to provide a vertically adjustable upper stop for the exit end of the upper roller support. Lock nuts 41*a* and 42*a* are provided on the screws to enable locking the same in adjusted position. A link 48 is pivotally connected at one end by a cross pin 49 to ears on the upper roller support and at its other end by a cross pin 51 to the cover, to constrain the upper roller support against movement in a direction lengthwise of the pass line, while accommodating adjustment of the upper roller support in a direction transverse to the pass line.

A longitudinal adjusting means is provided for adjusting the lower roller support 23 in a direction longitudinally of the pass line. As best shown in FIG. 2, the longitudinal adjusting means includes a lead screw 55 that is rotatably supported in the base 21 and which has a threaded end portion 55*a* that threadedly engages the guide block 24 attached to the lower roller support, to adjust the lower roller support in response to rotation of the lead screw. The lead screw has a thrust collar 56 at one end that is retained in a counterbore in the end of the base by a cap plate 57, and a knob 58 is attached to the end of the lead screw to enable manual turning of the same. As shown in FIG. 4, a lock screw 59 is threaded in the base and extends transverse to the guide block 24 and has a knob 60 at its outer end to enable manual turning of the same to a position engaging the guide block to lock the same against movement.

Pinch rollers 65 and 66 are provided adjacent the inlet end of the straightener apparatus and provision is made for braking rotation of at least one of the pinch roller so that the strip stock is tensioned as it is pulled through the straightening apparatus. As best shown in FIGS. 2 and 3, the lower pinch roller 65 is rotatably supported as by bearings 68 on a cross shaft 69. Brake disks 71 and 72 are non-rotatably connected by pins 70 and 74 to opposite ends of the lower pinch roller 65. The brake disk 71 engages a brake plate 75 that is non-rotatably connected by pins 76 to a side wall of the base 21. The other brake disk 72 engages the end face of a flanged bushing 77 that is slidably and non-rotatably keyed at 78 to an opposite side wall of the base 21. A nut 81 and thrust washer 82 on one end of the shaft 69 engages a side wall of the base to hold the shaft against movement in one direction, that is to the left as viewed in FIG. 3, and a nut 83 and spring washer 84 on the other end of the shaft engages the bushing 77. The nut 83 is tightened sufficient to press the bushing against the brake disk 72 and to also press roller 65 axially until the brake disk 71 presses against the brake plate 72. This arrangement provides an adjustable braking action on the lower pinch roller 65, which is adjustable by the nut 83 and spring washer 84.

The upper pinch roller 66 is mounted on the cover and is yieldably biased toward the lower pinch roller. As best shown in FIGS. 2 and 3, the upper pinch roller 66 is rotatably supported by bearings 86 on a cross shaft 87. The cross shaft 87 is mounted on a pinch roller support 88 that is supported for limited pivotal movement on cross shaft 33 about an axis parallel to the shaft 87. The upper pinch roll support is yieldably urged downwardly by a compression spring 89 and the compression on the spring is adjustable as by a screw 91 that is threaded into the cover, and which can be locked in adjusted position by a nut 91*a*. A stop plate 92 is mounted on the cover to limit downward movement of the upper pinch roll support when the cover is open.

Figure 6:
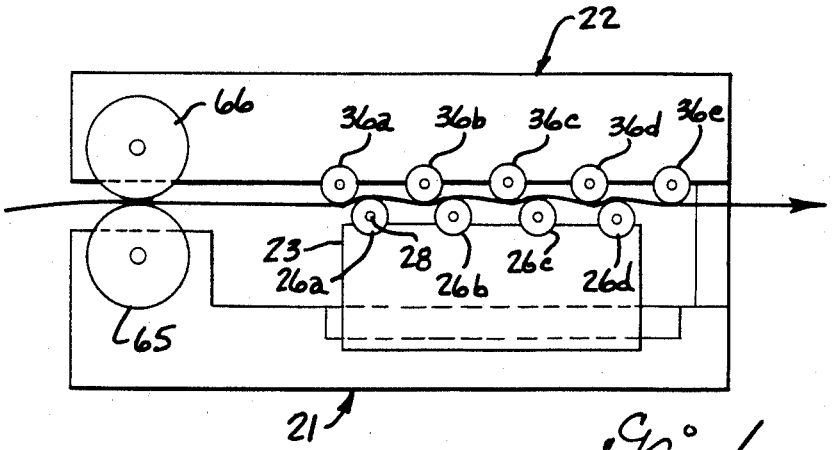
FIGS. 6 and 7 are diagrammatic views illustrating the straightening apparatus in different adjusted positions.
Figure 7:
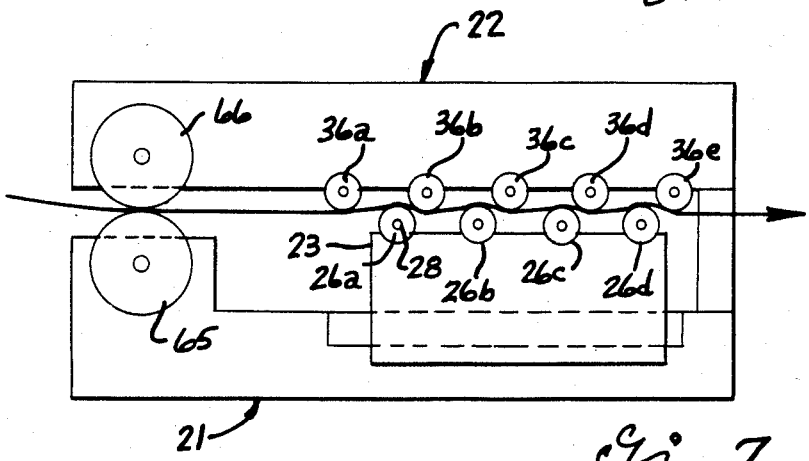

From the foregoing it is thought that the construction and operation of the straightening apparatus of FIGS. 1–7 will be readily understood. The spacing between the lower leveler rollers 26*a*–26*d* on the lower roller support remains fixed and the spacing between the upper leveler rollers 36*a*–36*e* on the upper roller support also remains fixed. However, the lower roller support 23 is adjustable in a direction paralleling the pass line of the strip stock from a position in which the lower leveler rollers are each disposed between and equi-distant from two adjacent upper leveler rollers, and into positions in which each lower leveler roller is disposed between but relatively closer to the upstream one of the two adjacent upper leveler rollers, as shown in FIG. 6, and to positions in which the lower leveler rollers are disposed between but relatively closer to the downstream one of the two adjacent upper leveler rollers, as shown in FIG. 7. When the lower leveler rollers are disposed closer to the upstream one of the two adjacent upper leveler rollers, the upward bending of the strip material is greater than the downward bending so that the straightener compensates for down coil set in the strip stock. Conversely, when the lower rollers are disposed relatively closer to the downstream one of the associated pair of upper rollers, the downward bending is greater than the upperward bending of the strip material and the straightener compensates for up coil set in the strip material entering the straightener. The pinch rolls apply a braking or retarding action to the strip material as it is pulled through the straightener and thus further enhances the straightening and leveling action.

The upper roller support is adjustable in a direction transversly of the pass line and the positions of the inlet and outlet ends of the upper roller support can be independently adjusted so as to vary the amount of bending that occurs in the strip material as it progresses between the upper and lower leveler rollers.

A modified form of apparatus for straightening strip material utilizing powered leveler rollers is illustrated in FIGS. 8–13. The straightening apparatus in this embodiment includes a base 121 and a cover 122. The base has spaced upstanding side walls 121*a* and 121*b* and an end wall 121*c*. A series of lower leveler rollers, herein shown five in number and designated 126*a*–126*e*, are rotatably mounted in parallel relation on the side walls 121*a* and 121*b* of the base. The lower leveler rollers preferably have a like outer diameter and their axes are spaced apart on the base at a uniform fixed distance with their upper peripheries disposed tangent to a lower roller plane.

The cover 122 is mounted on a shaft 131 for swinging movement between a closed or operating position shown in the drawings and a raised position to facilitate threading of the strip material through the straightener. A latch 132 operated by a thumb screw 133 is provided for releasably latching the cover in its closed position.

A rigid upper roller support 135 is mounted on the cover for adjustment relative to the cover along a first path lengthwise of the pass line of the strip material and also for adjustment relative to the cover along a second path transverse to the pass line. A plurality of upper leveler rollers, herein shown six in number and designated 136*a*–136*f* are mounted on the upper roller support with their axes parallel and uniformly spaced apart a fixed distance equal to the spacing of the axes of the lower leveler roller, and with their undersides tangent to an upper roller plane. The spacing between the axes of the upper leveler rollers is substantially greater than the diameter of the rollers and preferably about two times the roller diameter. The upper leveler rollers are preferably of like outer diameter the same as the lower leveler rollers and are provided with bearings adjacent opposite ends that rotatably support the rollers on axles 137 extending between ears 135*a* on the upper roller support 135. The lower leveler rollers are fixed on shafts 128 that are rotatably supported in bearings on the side walls 121*a* and 121*b* of the base. A lever 148 is pivotally mounted intermediate its ends on a cross pin 149 on the cover for pivotal movement about an axis parallel to the leveler rollers, and links 150 are pivotally mounted at their upper ends by pins 151 on one end of the lever 148. The links 150 are pivotally connected at their lower ends by pins 152 to ears 135*b* at the upper side of the upper roller support 135 adjacent one end of the latter. A compression spring 138 is interposed between the underside of the cover and the end of the leveler 148 remote from the pin 151, to yieldably urge the lever 148 in a direction to bias the links 150 and the inlet end of the upper roller support 135 to a raised position. A tension spring 139 is attached to ears at the underside of the cover and to ears on the upper side of the upper roller support 135 at a location to yieldably urge the outlet end of the upper roller support to a raised position. An adjusting screw 142 is threaded in the cover and engages the lever 148 at a location adjacent the links 150 to adjust upward movement of the inlet end of the upper roller support. A second adjusting screw 141 is threaded in the cover and engages the upper roller support adjacent its outlet end to control the upper position of the outlet end of the upper roller support. With this arrangement the inlet and outlet ends of the upper roller support can be independently adjusted along a path transverse to the pass line. The upper roller support is also adjustable in a direction longitudinally of the pass line. For this purpose, a screw 155 is rotatably and non-slidably mounted in an end wall 122*a* of the cover, and the screw threadedly engages a cross head 156. The cross head 156 has pins 156*a* at opposite ends that extend into vertically elongated slots 150*a* in the links 150. Thus, the screw 155 can be turned in one direction or the other to shift the cross head 156 in a direction lengthwise of the pass line and thereby adjust the position of the upper roller support in a direction lengthwise of the pass line. The vertically elongated slots 150*a* accommodate vertical adjustment of the inlet end of the upper roller support by screw 142 and spring 138. The lower leveler rollers 126*a*–126*e* have gears 175*a*–175*e*, respectively on one end. Idler gears 176*a*–176*d* are mounted on stub shafts on one of the side walls 121*a* of the base and mesh with adjacent ones of the gears 175*a*–175*e* to drive the lower leveler rollers at the same peripheral speed and in the same direction. The lower leveler rollers are driven from an input gear 177 on a shaft 178, through intermediate idler gears 179, 180 and 181, as best shown in FIG. 9.

Figure 10:
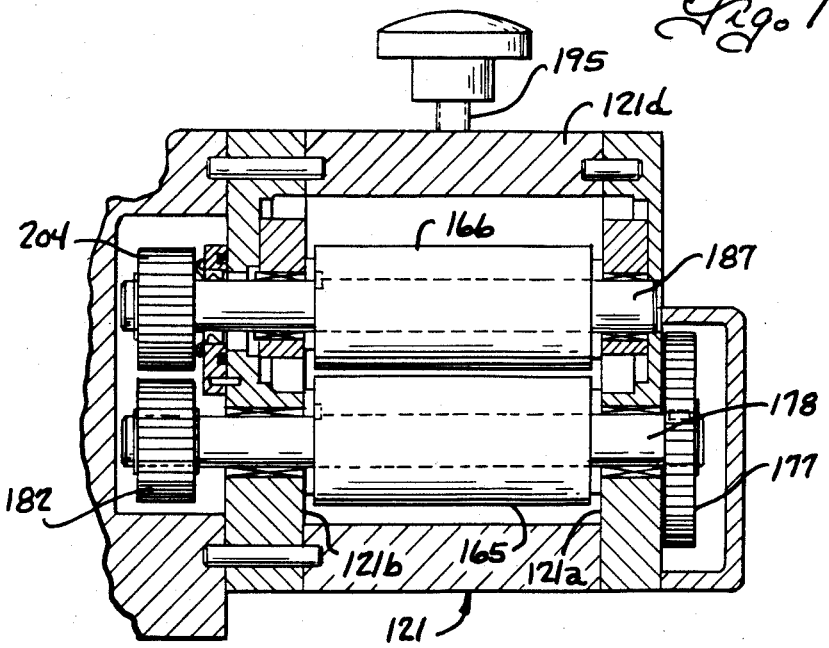
FIG. 10 is a transverse sectional view taken on the plane 10—10 of FIG. 9.
Figure 11:
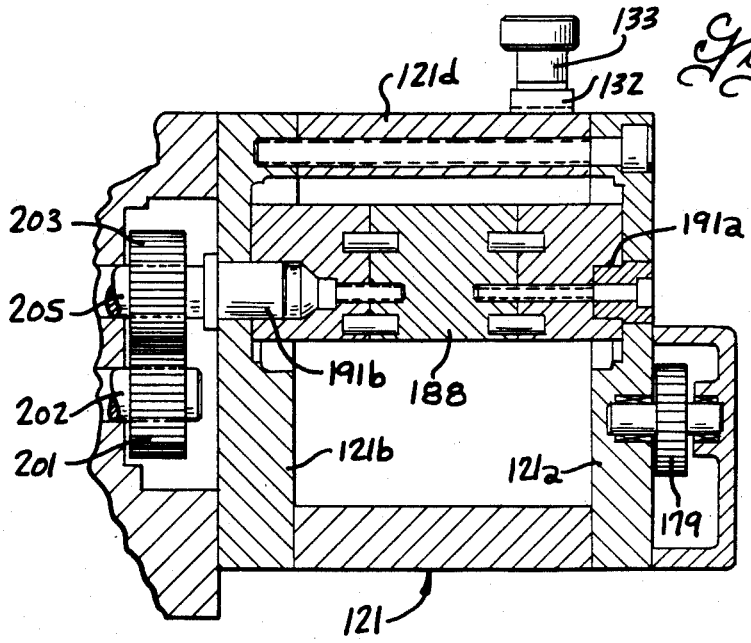
FIG. 11 is a transverse sectional view taken on the plane 11—11 of FIG. 9.

Powered pinch rollers 165 and 166 are provided at the outlet end of the straightening apparatus for pulling strip material through the leveler rollers. The lower pinch roll 165 is non-rotatably keyed to a shaft 178 and the gear train including gears 177, 179, 180 and 181 is arranged so as to drive the lower leveler rollers 126*a*–126*e* at the same peripheral speed as the lower pinch roller 165. As best shown in FIG. 10, the shaft 178 is rotatably supported by bearings in the opposed side walls 121*a* and 121*b* of the base, and the shaft 178 has a gear 182 keyed to its end remote from the gear 177. The upper pinch roll 166 is non-rotatably keyed to a shaft 187 that is rotatably supported by bearings on an upper pinch roll support 188. The upper pinch roll support is swingably mounted on trunnions 191*a* and 191*b* on the base for movement about an axis parallel to the axis of the upper pinch roller 186. The base 121 has a rigid upper cross head 121*d* and the upper pinch roller 166 is yieldably urged to a raised position by a compression spring 189 interposed between the cross head and the upper pinch roller support 188 at the side of the pivot axis remote from the pinch roller. An adjusting screw 195 is threaded in the cross head 121*d* and engages the upper pinch roller to adjust the clearance between the upper and lower pinch rollers. A power input drive gear 201 non-rotatably keyed to an input drive shaft 202 driven by a drive motor (not shown) meshes with an idler gear 203 that is rotatably supported on a stub shaft 205 coaxial with the pivot axis of the upper pinch roller support 188, and idler gear 203 meshes with a gear 204 (FIG. 10) that is non-rotatably keyed to the upper pinch roller shaft 187 to drive the upper pinch roller. The drive gear 201 also drivingly engages the gear 182 on the lower pinch roller shaft to drive the lower pinch roller at the same peripheral speed as the upper pinch roller.

Figure 8:
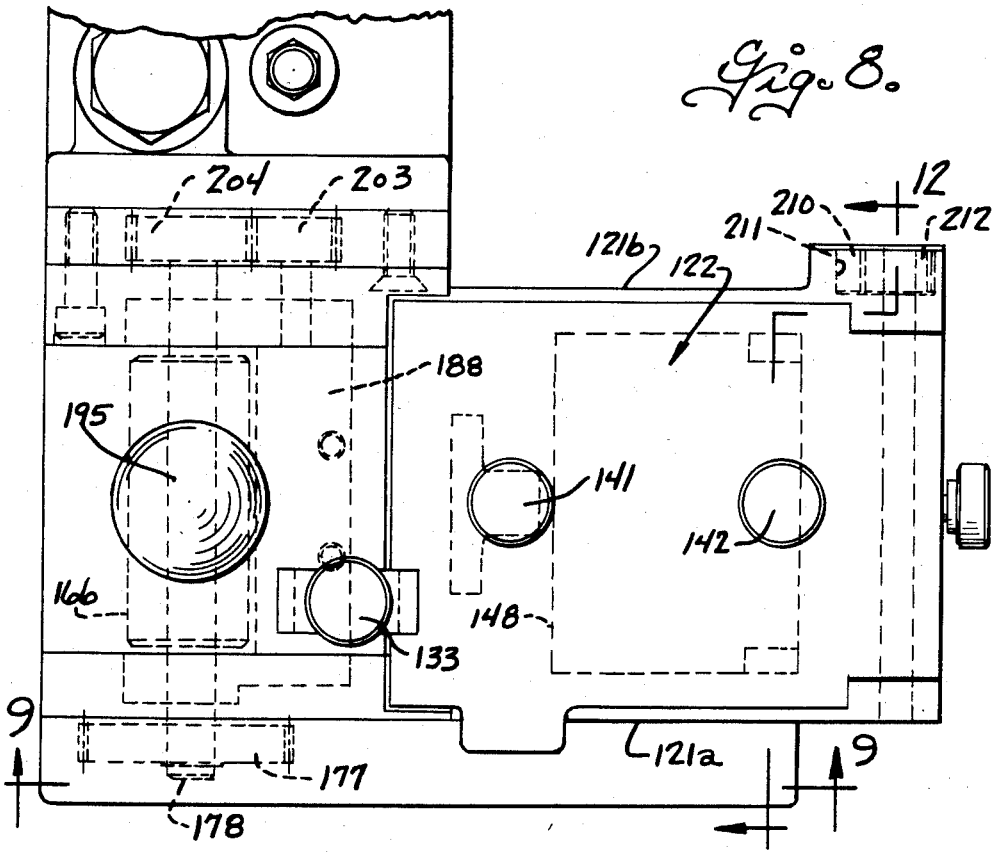
FIG. 8 is plan view of another straightening apparatus embodying the present invention.
Figure 12:
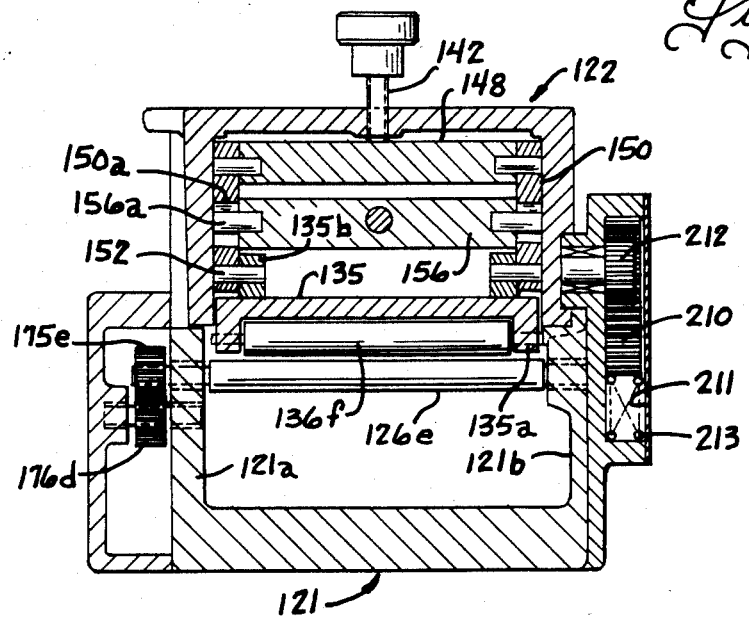
FIG. 12 is a transverse sectional view taken on the plane 12—12 of FIG. 9.

A counterbalance mechanism is advantageously provided for the cover 122. As best shown in FIGS. 8 and 12, a rack 210 is mounted for vertical sliding movement in a trackway 211 on the base, and the rack meshes with a pinion gear 212 that is non-rotatably keyed to the cross shaft 131. The cover is also non-rotatably keyed to the cross shaft so that the rack is moved upwardly as the cover is raised and downwardly as the cover is lowered. The spring 213 yieldably opposes downward movement of the rack cover and is selected of a strength so as to at least substantially counterbalance the cover and the upper leveler roller assembly mounted thereon.

Figure 9:
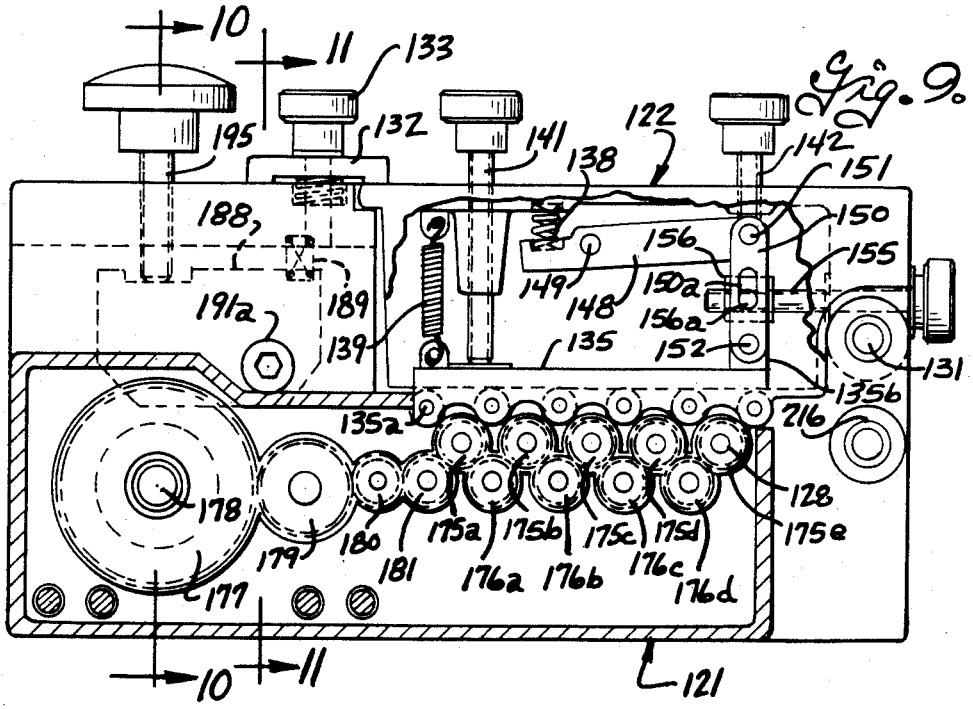
FIG. 9 is a fragmentary longitudinal sectional view taken on the plane 9—9 of FIG. 8.
Figure 13:
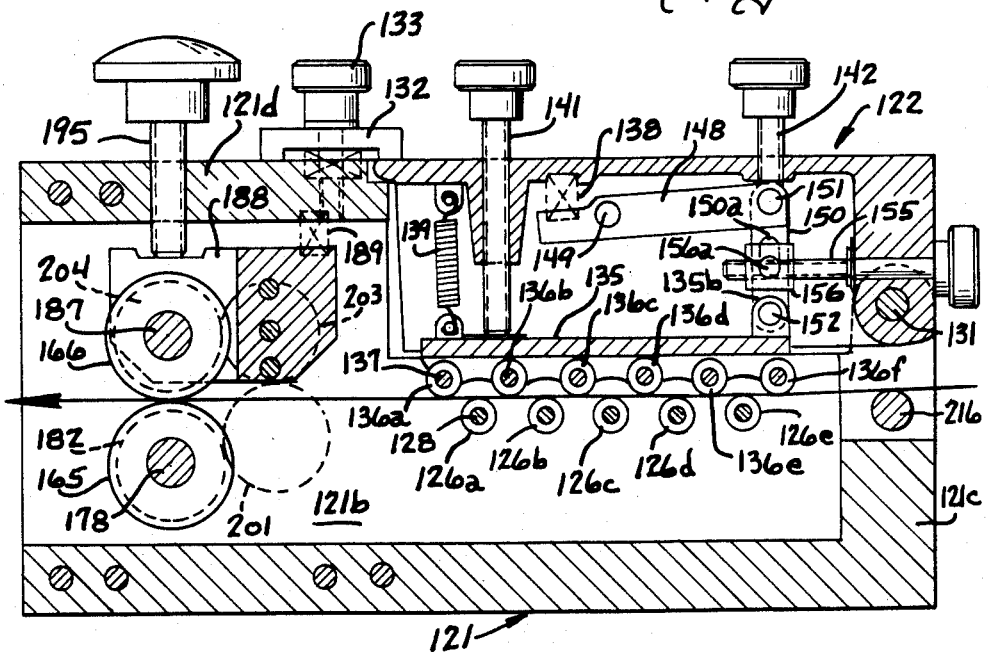
FIG. 13 is a longitudinal sectional view taken on the plane 13—13 of FIG. 8.

As shown in FIGS. 9 and 13, an entrance guide roller 216 is mounted on the base at the inlet end of the straightening apparatus to guide the strip material into the leveler rolls. The inlet guide roller does not perform any straightening function.

The straightening apparatus of the embodiment of FIGS. 8–13 operates in a manner similar to that previously described in connection with FIGS. 1–7, except that the pinch rollers and the lower feed rollers are driven at the same peripheral speed to feed the stock through the straightening apparatus. The upper roller support 135 and the upper leveler rollers 136*a*–136*f* thereon can be adjusted longitudinally relative to the lower leveler rollers 126*a*–126*e* from a position in which each lower leveler roller is disposed between and equidistant from the associated pair of upper leveler rollers and to position in which each lower leveler roller is disposed between and relatively closer to either the upstream one or the downstream one of the associated pair of upper leveler rollers. The upper roller support can also be adjusted in a path transverse to the pass line of the strip material by screws 142 and 141 which enable independent adjustment of the spacing at the inlet and outlet ends of the leveler rollers.

The embodiments of the invention in which an exclusive property or privilege is claimed are defined as follows:

1. An apparatus for straightening strip material as it passes in one direction therethrough along a stock pass line comprising, a rigid first roller support, a first series of leveler rollers rotatably mounted in parallel relation on the first roller support with their peripheries tangent to a first roller plane, the axes of the leveler rollers of the first series being uniformly spaced apart on the first roller support a fixed distance, a rigid second roller support, a second series of leveler rollers rotatably mounted in parallel relation on the second roller support with their peripheries tangent to a second roller plane, the axes of the leveler rollers of the second series being uniformly spaced apart on the second roller support a fixed distance the same as the spacing of the leveler rollers of the first series, means mounting the first and second roller supports at relatively opposite sides of the stock pass line for relative adjustment along a first path lengthwise of the stock pass line and also for relative adjustment along a second path transverse to the stock pass line, selectively operable longitudinal adjusting means for adjusting the first and second roller supports relative to each other along said first path from a position in which the leveler rollers of one series are each disposed between and equi-distant from two adjacent leveler rollers of the other series to positions in which the leveler rollers of said one series are disposed between and relatively closer to either the upstream one or the downstream one of the two adjacent leveler rollers of the other series, and selectively operable transverse adjusting means for adjusting said first and second roller supports relative to each other along said second path.

2. An apparatus for straightening strip material according to claim 1 wherein the number of leveler rollers in said other series is one more than the number of leveler rollers in said one series.

3. An apparatus for straightening strip material according to claim 1 wherein said transverse adjusting means includes a first means for relatively adjusting the first and second roller supports along said second path adjacent the end where the strip material enters the pass line therebetween and a second means for relatively adjusting the first and second roller supports along said second path adjacent the end where the strip material exits the pass line therebetween.

4. An apparatus for straightening strip material according to claim 1 wherein the apparatus includes a support base, said first roller support being mounted on said base for adjustment relative thereto along said first path, said second roller support being mounted on said base for adjustment relative thereto along said second path.

5. An apparatus for straightening strip material according to claim 4 wherein the leveler rollers of the first and second series are non-powered, the apparatus including a pair of pinch rollers mounted on the base at a location to have the strip material pass therebetween before passing to the leveler rollers, and brake means for retarding rotation on at least one of the pinch rollers to tension the strip material when it is drawn through the straightening apparatus.

6. An apparatus for straightening strip material according to claim 1 wherein the apparatus includes a support base and said first roll support is a fixed part of said base, said means for mounting the first and second roller supports supporting the second roller support for movement relative to the base along said first path and said second path.

7. An apparatus for straightening strip material according to claim 6 including means on the base for driving each of the leveler rollers of the first series at the same peripheral speed.

8. An apparatus for straightening strip material according to claim 7 including a pair of pinch rollers mounted on the base and disposed at opposite sides of the pass line, and means on the base for driving the pinch rollers at the same peripheral speed as the leveler rollers of said first series.

9. An apparatus for straightening strip material according to claim 1 wherein the apparatus includes a support base and a cover mounted on the base for swinging movement relative thereto about an axis parallel to the axes of the leveler rollers into and out of a closed operating position, means for latching the cover closed in its closed operating position, said means for mounting the first and second roller supports supporting the first roller support on the base and the second roller support on the cover.

10. An apparatus for straightening strip material according to claim 9 wherein said first roller support is mounted on the base for adjustment relative thereto along said first path and said second roller support is mounted on the cover for adjustment relative thereto along said second path.

11. An apparatus for straightening strip material according to claim 9 including a first pinch roller mounted on said base and a second pinch roller mounted on said cover, and brake means for retarding rotation of one of said pinch rollers.

12. An apparatus for straightening strip material according to claim 9 wherein said first roller support is a fixed part of said base, said second roller support being mounted on said cover for adjustment relative thereto along said first path and said second path.

13. An apparatus for straightening strip material according to claim 12 including means on said base for driving the leveler rollers of the first series at the same peripheral speed.

14. An apparatus for straightening strip material according to claim 13 including a pair of pinch rollers mounted on said base, and means for driving said pinch rollers at the same peripheral speed as said leveler rollers of the first series.

15. An apparatus for straightening strip material according to claim 1 wherein the leveler rollers of the first series and the second series are of like diameter.

16. An apparatus for straightening strip material as it passes in one direction therethrough along a stock pass line comprising, a base, a cover hinged to said base for swinging movement relative thereto about a generally horizontal axis into and out of a closed operating position, means for latching the cover in its closed operating position, a rigid lower roller support guidably mounted on the base for adjustment relative thereto along a first path lengthwise of the stock pass line, a series of lower leveler rollers rotatably mounted in parallel relation on the lower roller support with their peripheries tangent to a first roller plane, the axes of the lower leveler rollers being uniformly spaced apart on the lower roller support a fixed distance, a rigid upper roller support, means mounting the upper roller support on the cover for adjustment relative thereto along a second path transverse to the stock pass line, said means mounting the upper roller support including means for inhibiting movement of the upper roller support in a direction lengthwise of the stock pass line, a series of upper leveler rollers rotatably mounted in parallel relation on the upper roller support with their peripheries tangent to a second roller plane, the axes of the upper leveler rollers being uniformly spaced apart on the upper roller support a fixed distance equal to the spacing between the axes of the lower leveler rollers on the lower roller support, selectively operable longitudinal adjusting means for adjusting the lower roller support along said first path relative to the base from a position in which the lower leveler rollers are each disposed between and equi-distant from an associated pair of adjacent upper leveler rollers to positions in which each lower leveler roller is disposed between and relatively closer to either the upstream one or the downstream one of an associated pair of adjacent upper leveler rollers, and selectively operable transverse adjusting means for adjusting said upper roller support relative to the cover and toward and away from the lower roller support.

17. An apparatus for straightening strip material according to claim 16 wherein said transverse adjusting means includes a first means for adjusting the upper roller support relative to the cover along said second path adjacent the end where the strip material enters the pass line between the upper and lower leveler rollers and a second means for adjusting the upper roller support relative to the cover along said second path adjacent the end where the strip material exits from the pass line between the upper and lower leveler rollers.

18. An apparatus for straightening strip material according to claim 16 including a lower pinch roller mounted on said base, an upper pinch roller mounted on said cover for movement therewith into opposed relation with the lower pinch roller when the cover is in its operating position.

19. An apparatus for straightening strip material according to claim 16 wherein the lower leveler rollers and the upper leveler rollers are of like diameter.

20. An apparatus for straightening strip material as it passes in one direction therethrough along a pass line comprising, a base, a cover hinged to said base for swinging movement relative thereto about a generally horizontal axis into and out of an operating position, means for latching the cover in its operating position, a series of lower leveler rollers rotatably mounted in parallel relation on said base with their peripheries tangent to a first roller plane, the axes of the lower leveler rollers being uniformly spaced apart on the base a fixed distance, a rigid upper roller support, means mounting the upper roller support on the cover for adjustment relative to the cover along a first path lengthwise of the pass line and also for adjustment relative to the cover along a second path transverse to the pass line, a series of upper leveler rollers rotatably mounted in parallel relation on the upper roller support with their lower peripheries tangent to a second roller plane, the axes of the upper leveler rollers being uniformly spaced apart on the upper roller support a fixed distance equal to the spacing between the axes of the lower leveler rollers on the lower support, selectively operable longitudinal adjusting means for adjusting the upper roller support relative to the cover along said first path from a position in which each lower leveler roller is disposed between and equi-distant from an associated pair of upper leveler rollers and to positions in which each lower leveler roller is disposed between and relatively closer to either the upstream one or the downstream one of an associated pair of upper leveler rollers, and selectively operable transverse adjusting means for adjusting said upper roller support relative to the cover toward and away from the lower roller support.

21. An apparatus for straightening strip material according to claim 20 wherein said transverse adjusting means includes a first means for adjusting the upper roller support relative to the cover along said second path adjacent the end where the strip material enters the pass line between the upper and lower leveler rollers and a second means for adjusting the upper roller support relative to the cover along said second path adjacent the end where the strip material exits from the pass line between the upper and lower leveler rollers.

22. An apparatus for straightening strip material according to claim 20 including upper and lower pinch rollers mounted on said base adjacent one end and at opposite sides of the pass line, and means for driving said pinch rollers.

23. An apparatus for straightening strip material according to claim 20 wherein the lower leveler rollers and the upper leveler rollers are of like diameter.

* * * * *